US006530795B2

(12) United States Patent
Maeda et al.

(10) Patent No.: US 6,530,795 B2
(45) Date of Patent: Mar. 11, 2003

(54) UNITABLE TERMINAL FITTING, A CONSTRUCTION FOR UNITING A PLURALITY OF TERMINAL FITTINGS AND METHOD FOR FORMING A UNITABLE TERMINAL FITTING

(75) Inventors: Tatsuya Maeda, Yokkaichi (JP); Tetsuya Shinozaki, Yokkaichi (JP); Kazuhiro Aoki, Aichi-ken (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/096,480

(22) Filed: Mar. 12, 2002

(65) Prior Publication Data

US 2002/0132507 A1 Sep. 19, 2002

(30) Foreign Application Priority Data

Mar. 13, 2001 (JP) ..... 2001-071061

(51) Int. Cl.[7] ..... H01R 13/28
(52) U.S. Cl. ..... 439/287; 439/907
(58) Field of Search ..... 439/284, 287, 439/288, 907, 883

(56) References Cited

U.S. PATENT DOCUMENTS 5,558,531 A * 9/1996 Ikeda et al. ..... 439/287
5,577,927 A * 11/1996 Okada et al. ..... 439/287
5,759,055 A * 6/1998 Colantuano et al. ..... 439/287
5,865,637 A * 2/1999 Shinozaki et al. ..... 439/287
5,934,923 A * 8/1999 Matsuoka et al. ..... 439/287
6,086,399 A * 7/2000 Matsunaga et al. ..... 439/287

FOREIGN PATENT DOCUMENTS

JP 11-67305 3/1999

* cited by examiner

*Primary Examiner*—Tho D. Ta
*Assistant Examiner*—Edwin A. León
(74) *Attorney, Agent, or Firm*—Anthony J. Casella; Gerald E. Hespos

(57) ABSTRACT

A terminal fitting (1) is provided with a wire connecting portion (3) to be connected with an end of a wire (W) and a shaft fixing portion (5) through which a bolt (4) is insertable. The shaft fixing portion (5) is formed by folding a metallic plate material in three. Each of exposed surface portions (8, 9) located at the front and rear surfaces of the shaft fixing portion (5) is provided with engaging portions (10, 11) for holding the adjacent terminal fittings fixed by engaging with the mating engaging portions (11, 10).

12 Claims, 10 Drawing Sheets

UNITABLE TERMINAL FITTING, A CONSTRUCTION FOR UNITING A PLURALITY OF TERMINAL FITTINGS AND METHOD FOR FORMING A UNITABLE TERMINAL FITTING

BACKGROUND OF THE INVENTION

1. Field of the Invention

The present invention relates to a unitable terminal fitting, a construction for uniting a plurality of terminal fittings and to a method for forming or assembling a unitable terminal fitting.

2. Description of the Related Art

Unitable terminal fittings are disclosed in Japanese Unexamined Patent Publication No. 11-67305 and are identified by the numerals 100 and 101 in FIGS. 12 and 13 herein. Each of the terminal fittings 100, 101 has a wire connecting portion 102 that can be connected with an end of a wire W and a shaft fixing portion 104 formed with an insertion hole 103 through which an unillustrated bolt is insertable. Engaging portions 105 and 106 are formed at opposite sides of the insertion hole 103 of each terminal fitting and are configured so that the engaging portions 105, 106 of one terminal fitting are engageable with the engaging portions 106, 105 of a mating terminal fitting. The two terminal fittings 100, 101 are united by sliding the shaft fixing portions 104 to align the insertion holes 103 with the engaging portions 105 located in the insertion holes 103 of the mating terminal fittings. The engaging portions 105, 106 of the two terminal fittings 100, 101 then are engaged and the terminal fittings 100, 101 are united with the insertion holes 103 aligned in thickness direction as shown in FIG. 13. The two terminal fittings 100, 101 then can be fixed to a specified location by one bolt.

The above-identified unitable terminal fittings 100, 101 enable no more than two wires W to be connected at one position. Thus, at least two fixing locations are required to fix three or more wires W.

In view of the above problem, an object of the present invention is to fix ends of three or more wires at one fixing location.

SUMMARY OF THE INVENTION

The invention is directed to a unitable or stackable terminal fitting with a wire connecting portion that can be connected with an end of a wire. The wire connecting portion is constructed so that a plurality of the terminal fittings can be placed one over another in the thickness or stacking direction of the terminal fittings. The stacked terminal fittings then can be united. The terminal fitting comprises first and second surfaces that are opposite to each other with respect to the thickness direction of the terminal fitting. The first and second surfaces each comprise engaging portions in the form of a projection and a recess configured so that the projection and recess on the first surface of one terminal fitting can engage the recess and projection on the second surface of a mating terminal fitting for holding the terminal fittings in a mated condition.

The wire connecting portion preferably is arranged so that the terminal fittings can be united with the wires substantially aligned.

Accordingly, ends of three or more wires can be placed one over another in thickness direction and can be united by the projections and recesses so that three or more wires can be fixed to one fixing location.

The terminal fitting is formed by bending a metallic plate material. The terminal fitting includes a shaft fixing portion for receiving a shaft to which the terminal fitting is to be fixed. The projection and recess are provided on exposed surfaces of outer layers at the front and rear sides of the shaft fixing portion where the metallic plate material is folded in three. The intermediate layer of plate material that is sandwiched between the two outer layers is held in close contact with the outer layers.

The shaft is fixed to a specified fixing location and is fixed to the shaft fixing portions of the engaged terminal fittings. The projections and recesses need to have a specified engagement margin in the thickness direction to be engageable in the thickness direction of the terminal fittings. The projections and recesses conceivably could be provided where the metallic plate material of the terminal fitting is folded in two. However, the two folded sections of the metallic plate material cannot be held in close contact to provide the engagement margin. Accordingly, a specified clearance has to be defined between the two folded sections of the metallic plate material. Thus, the clearance between the two folded sections can be squeezed by a compressive force in the thickness direction of the terminal fitting that acts when the terminal fitting is mounted on the shaft at the fixing location. However, even if such a compressive force acts, such a compressive force cannot squeeze the clearance between the exposed surfaces of the subject terminal fitting because the intermediate portion is held in close contact between exposed surfaces.

The shaft fixing portion preferably is formed by folding the metallic plate material at least in two, and mutually engaged assembling portions are provided at folded sections of the metallic plate material for preventing the folded sections of the metallic plate material of the shaft fixing portion from getting loose. The two bent portions preferably are in contact with each other at least via one or more contact projections. Accordingly, the folded sections of the metallic plate material of the shaft fixing portion are prevented from getting loose.

The wire connecting portions of the respective terminal fittings are located alternately at a first arranged position and at a second arranged position that is displaced in an offset direction from the first position. Thus, the wires do not interfere when the terminal fittings are united as compared to a case where the wire connecting portions are arranged at the same position.

Guide means preferably are provided for guiding the projections and recesses into engagement.

The projections and recesses preferably can be brought into engagement by moving them at an angle and preferably a right angle to a direction of mounting of the unitable terminal fitting to a shaft.

The projections and/or recesses preferably comprise a positioning edge that projects toward a shaft insertion hole so as to conform to the shaft.

The invention also is directed to a construction for uniting a plurality of terminal fittings to be fixed by one shaft. At least one unitable terminal fitting is an intermediate terminal fitting that is to be located at an intermediate position of the plurality of terminal fittings. Each of end terminal fittings located at the opposite ends of the plurality of terminal fittings along thickness direction comprises the wire connecting portion, the shaft fixing portion, one projection and one recess.

The intermediate terminal fitting preferably comprises a wire connecting portion to be connected with an end of a wire and a shaft fixing portion through which the shaft is insertable. Projections and recesses are provided around the shaft fixing portion on front and rear surfaces that face mating terminal fittings and are engageable with recesses and projections of the mating terminal fittings for holding the terminal fittings united.

Accordingly, the end terminal fittings located at the opposite ends in thickness direction are each provided with only one projection and recess. Thus, the united terminal fittings fixed by the shaft are held in surface contact at its shaft side and its fixing location. Therefore, the terminal fittings can be fixed stably.

Preferably, at least one end terminal fitting is provided with a turn-stop portion for preventing a turning of the terminal fitting(s).

The invention also is directed to a method for forming or assembling unitable terminal fittings. Each terminal fitting has a wire connecting portion for connection with an end of a wire. The wire connecting portion is constructed such that a plurality of the terminal fittings can be united while being placed one over another in the thickness direction of the terminal fittings. The method comprises providing a projection and a recess on each of the opposite first and second surfaces of the terminal fitting. The method may then comprise uniting the terminal fitting with a mating terminal fitting by engaging the respective recess and projection on the second surface of the respective mating terminal fitting.

The method may further comprise bending a metallic plate material to form the terminal fitting, providing the projections and recesses on a pair of exposed surfaces at sides of the shaft fixing portion where the metallic plate material is folded in three, and holding the plate material between the two exposed surfaces to serve as an intermediate portion held in close contact with the respective exposed surfaces.

The method may further comprise forming assembling portions at folded sections of the metallic plate material for preventing the folded sections of the metallic plate material that form the shaft fixing portion from getting loose.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
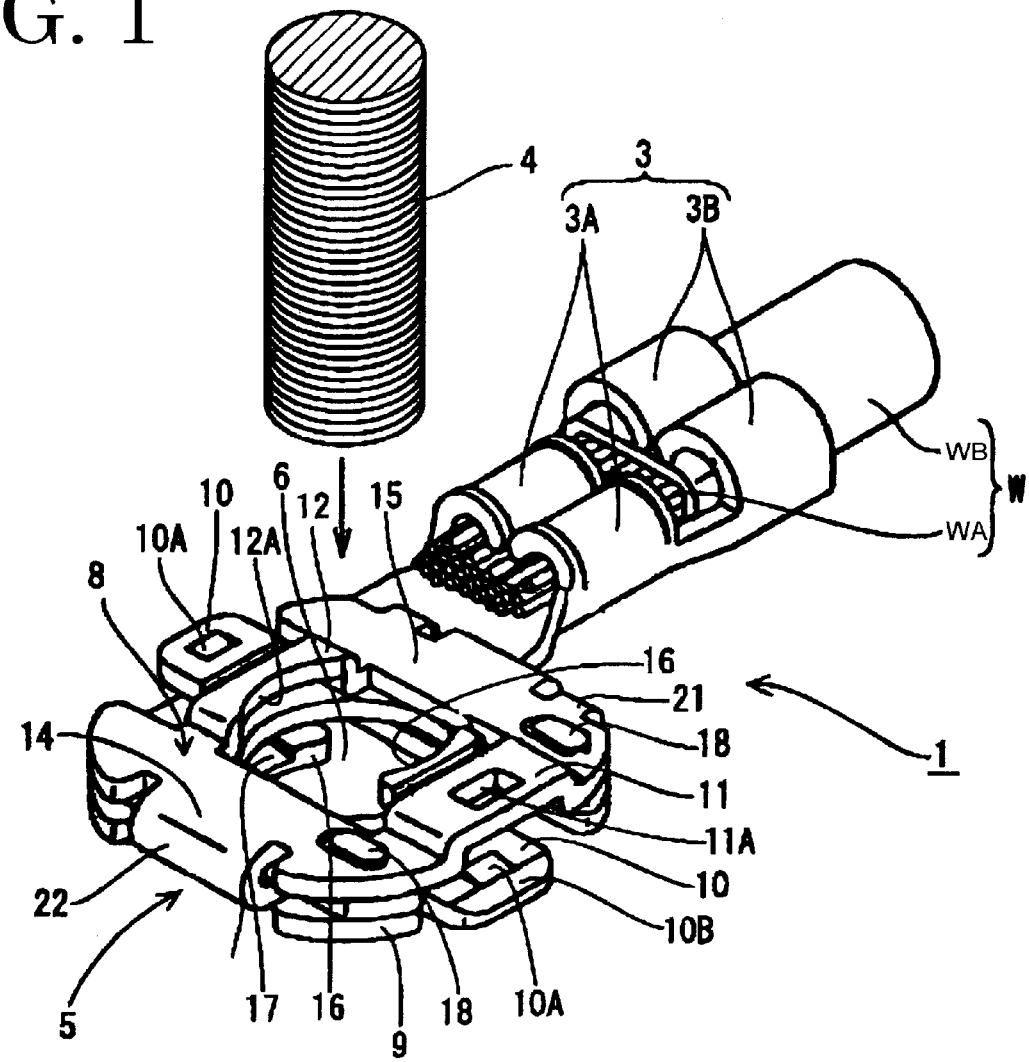
FIG. 1 is a perspective view of a unitable terminal fitting according to one embodiment of the invention.
Figure 9:
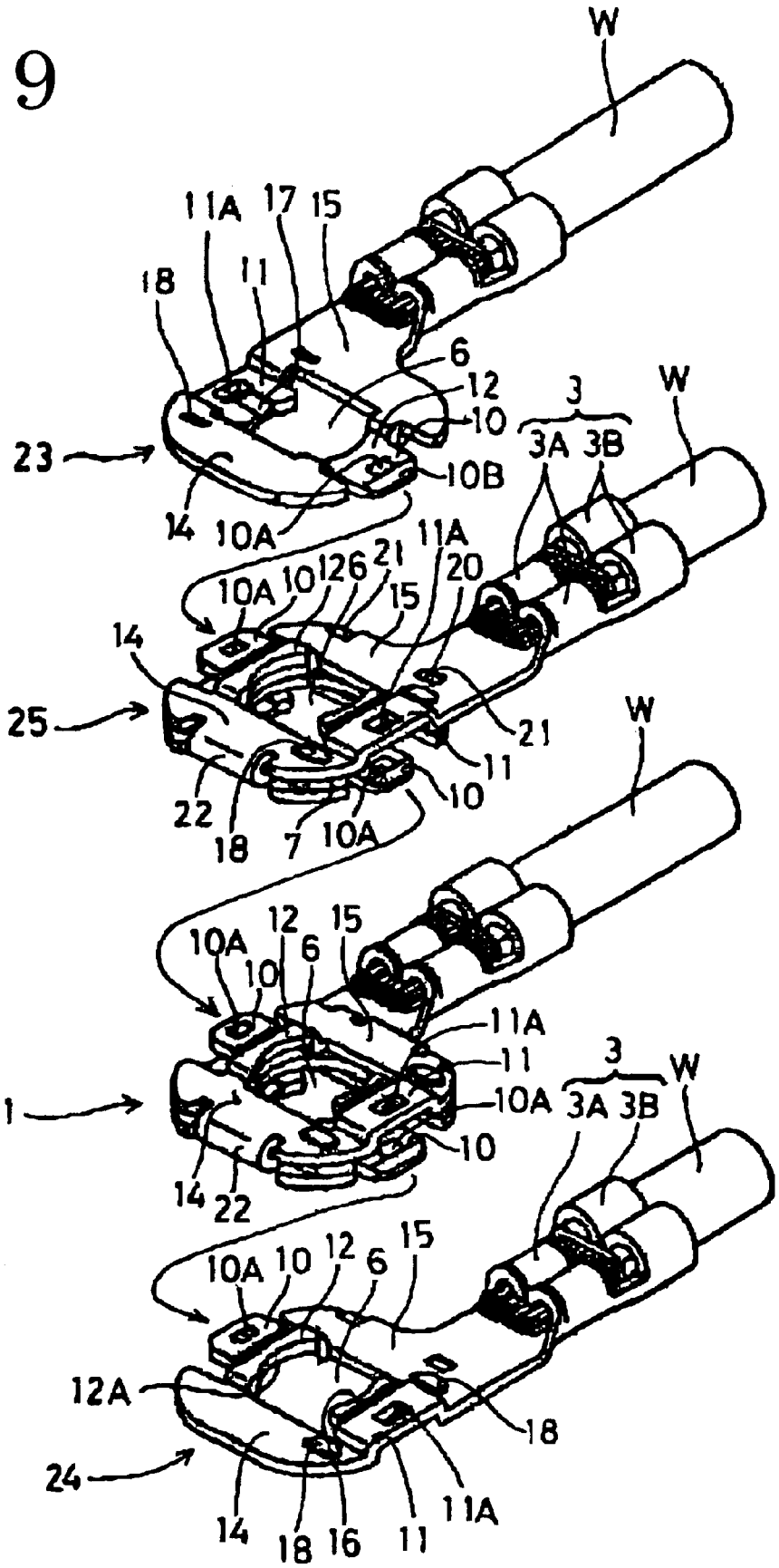
FIG. 9 is a perspective view showing a plurality of unitable terminal fittings (intermediate terminal fittings) and a pair of upper and lower end terminal fittings before being united.
Figure 10:
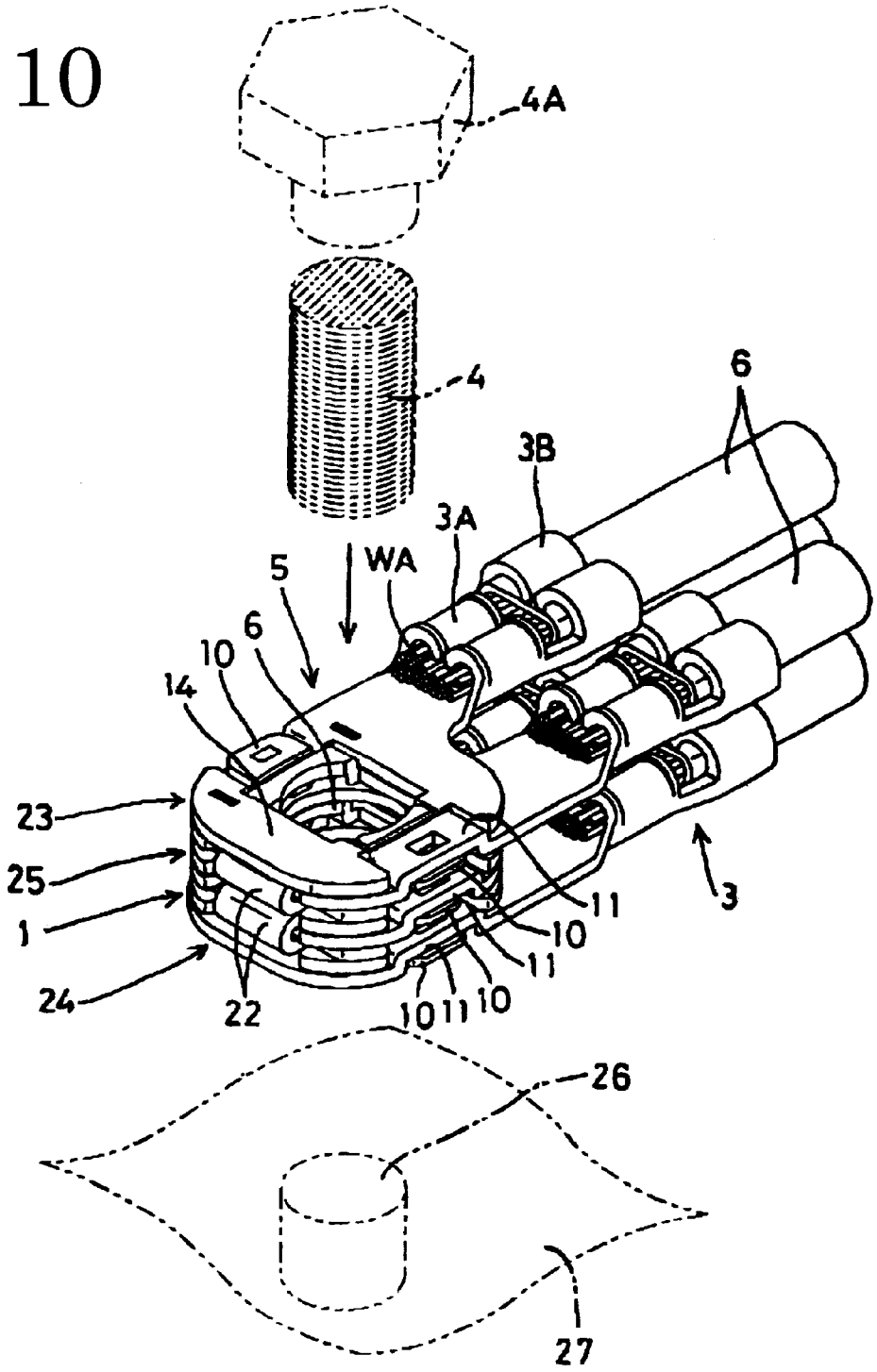
FIG. 10 is a perspective view of a plurality of terminal fittings united together.

A unitable terminal fitting in accordance with the invention is identified by the numeral 1 in FIG. 1, and is adapted to be stacked on and fixed to a mating terminal fitting, as described herein. The terminal fitting 1 is formed by bending a metallic plate 2 that has been stamped or cut out into the shape shown in FIG. 2. The terminal fitting 1 has opposed first and second ends. A wire connecting portion 3 is formed at the first end of the terminal fitting 1 and is configured to be connected with an end of a wire W. A shaft fixing portion 5 is formed at the second end of the terminal fitting 1 and has a hole configured to receive a shaft or bolt 4. As described later, the shaft fixing portion 5 is constructed so that a plurality of the shaft fixing portions 5 can be united by being placed one over another in thickness direction TD of the shaft fixing portion 5 or along the longitudinal direction of the bolt 4. As shown in FIGS. 9 and 10, a second type of terminal fitting 25 also is provided. A main difference between the terminal fittings 1 and 25 is a connecting position of the shaft fixing portion 5 and the wire connecting portion 3, as described in detail later. Thus, only the terminal fitting 1 is described in detail below and comparable parts of the terminal fitting 25 merely are identified by the same reference numerals.

The wire connecting portion 3 has two core connecting portions 3A and two insulation connecting portions 3B. The core connecting portions 3A are closer to the shaft fixing portion 5 and are crimped toward one another into connection with a core WA inside the wire W to electrically connect the wire W and the terminal fitting 1. The insulation connecting portions 3B are more distant from the shaft fixing portion 5 and also are crimped toward one another into a sheath WB of the wire W.

Figure 2:
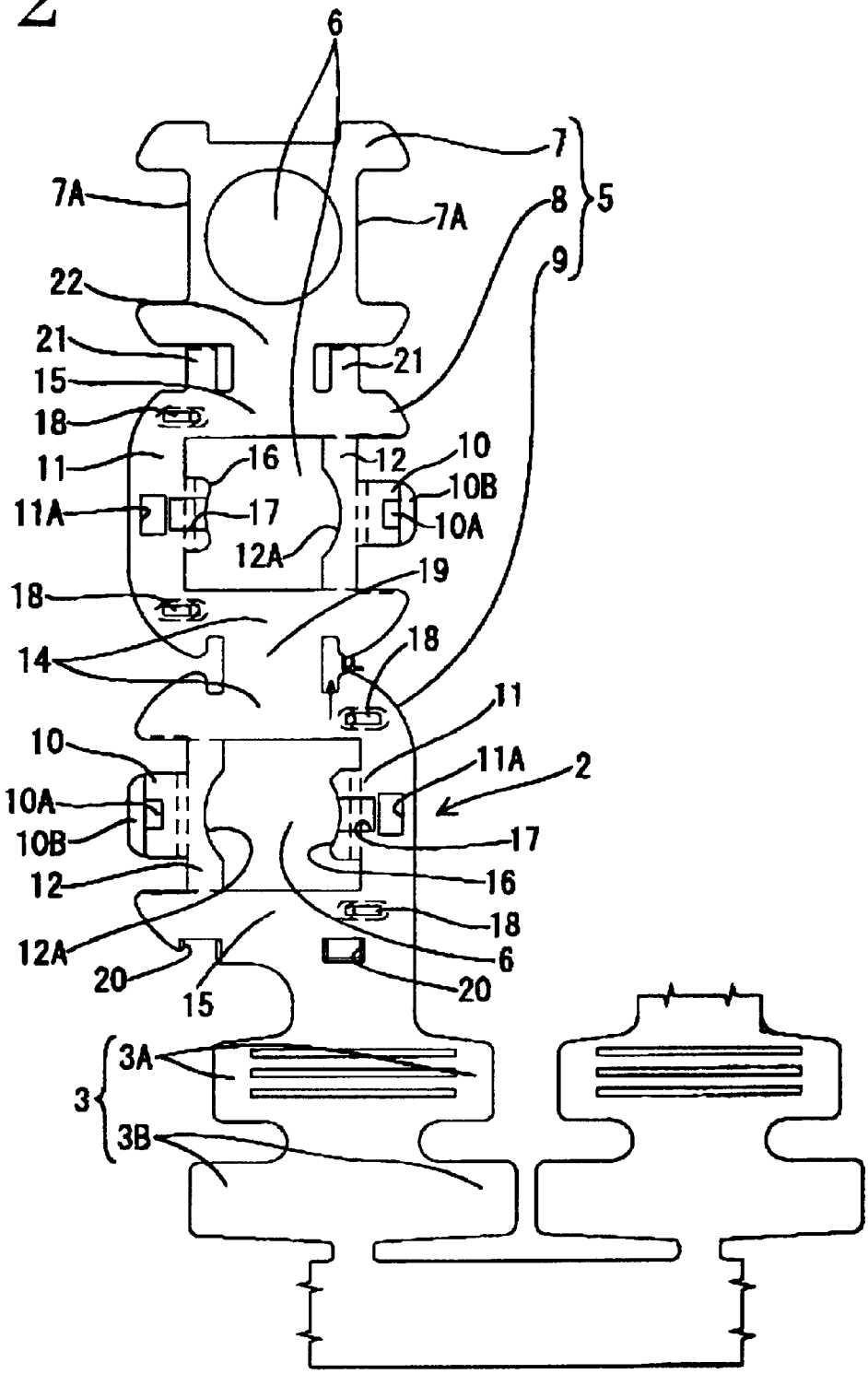
FIG. 2 is a development of the unitable terminal fitting.
Figure 3:
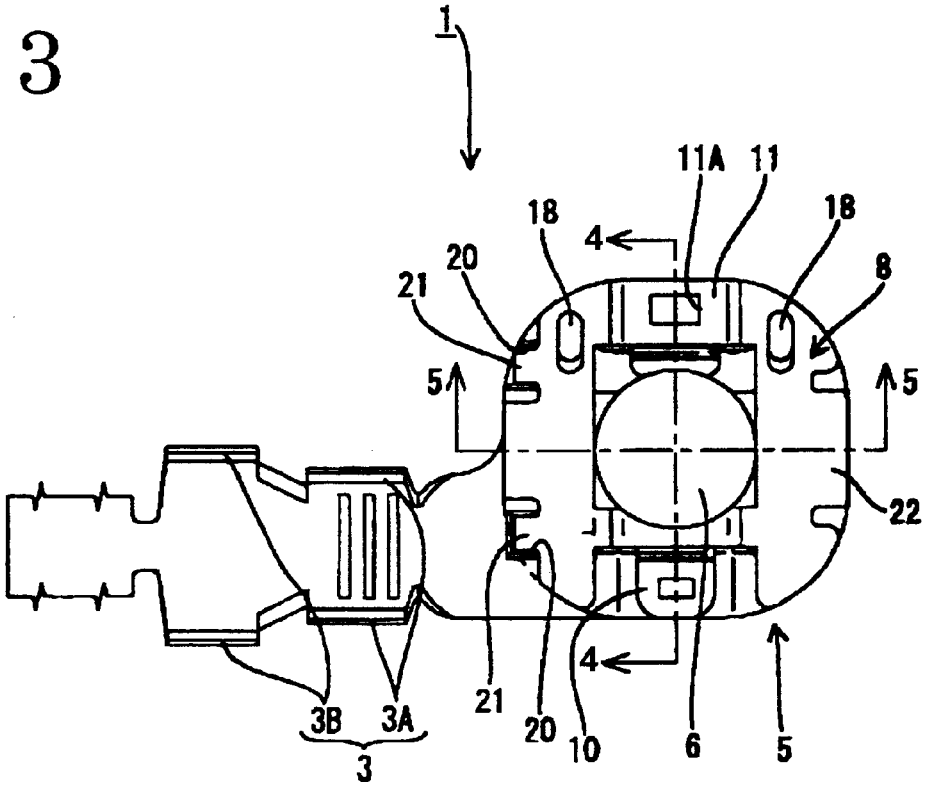
FIG. 3 is a plan view of the unitable terminal fitting.

The shaft fixing portion 5 is substantially in the form of a ring or a square having rounded corners. A bolt insertion hole 6 is formed in the center of the shaft fixing portion 5 and the bolt 4 is insertable through the bolt insertion hole 6. The shaft fixing portion 5 is formed by folding the metallic plate 2 to have a plurality of layered panels, e.g. in three, as shown in FIG. 2. The uppermost panel in FIG. 2 will define an intermediate panel 7 on the terminal fitting 1, and the two lower panels in FIG. 2 will define first and second exposed panels 8, 9 on the terminal fitting 1. The intermediate panel 7 is held tightly between the exposed panels 8, 9. The round bolt insertion hole 6 is formed in the center of the intermediate panel 7. As shown in FIG. 2, recesses 7A are formed at the left and right outer edges of the intermediate panel 7.

Each exposed panels 8, 9 has a first and second engaging portions 10 and 11 which are a projection and a recess that can be engaged with the second and first engaging portions 11, 10 of a mating terminal fitting to unit the terminal fittings 1. The respective engaging portions 10, 11 are at symmetrical positions on each exposed panel 8, 9 with respect to the bolt insertion hole 6. The construction of the respective engaging portions 10, 11 is described for the second exposed panel 9 with reference to FIG. 2, but no description is given for the same or similar elements of the first exposed panel 8 by identifying it by the same reference numerals.

The first engaging portion 10 of the second exposed panel 9 is at the left side of the bolt insertion hole 6 in FIG. 2 and is formed by an embossment that bulges out by a distance substantially corresponding to the thickness of the metallic plate 2. On the other hand, the second engaging portion 11 is at the right side of the bolt insertion hole 6 in FIG. 2, and is formed by an embossment that bulges out by a distance substantially corresponding to the thickness of the metallic plate 2.

The second exposed panel 9 has two wide portions 14, 15 that extend transversely above and below the bolt insertion hole 6. A bridging portion 12 vertically bridges the two wide portions 14, 15 and extends along the longitudinal direction of the metallic plate 2 at the left side of the bolt insertion hole 6. The second engaging portion 11 similarly bridges the two wide portions 14, 15 vertically and extends at the right side of the bolt insertion hole 6.

The first engaging portion 10 projects leftward away from the bolt insertion hole 6 substantially from the middle of the left edge of the bridging portion 12. A projection 10A is formed in the center of the first engaging portion 10 and projects toward the intermediate panel 7. The projection 10A is fittable into a hole 11A formed in the second engaging portion 11 of the mating terminal fitting. A slanted surface 10B is formed on a surface of the leading end of the first engaging portion 10 that faces the intermediate panel 7, so that the mating engaging portions 10, 11 can be engaged smoothly with each other. An arcuate positioning edge 12A is formed at the edge of the bridging portion 12 closer to the bolt insertion hole 6 and substantially conforms to the outer diameter of the bolt 4.

A positioning edge 16 projects toward the bolt insertion hole 6 from the left edge of the second engaging portion 11 and substantially conforms to the outer diameter of the bolt 4. The hole 11A is substantially in the center of the second engaging portion 11. Further, a guide groove 17 extends toward the hole 11A at the side of a middle portion of the positioning edge 16 toward the intermediate panel 7, which is the side where the mating first engaging portion 10 is fitted. The guide groove 17 smoothly guides an engaging movement of the mating engaging portions 10, 11.

A contact projection 18 is formed on each wide portion 14, 15 near the second engaging portion 11. The respective contact projections 18 are formed by embossing or by cutting and folding to project toward the surface to be brought into contact with the adjacent terminal fitting 1, so that the respective terminal fittings 1 can be held satisfactorily in contact.

The second wide portion 15 of the second exposed panel 9 is formed with recessed left and right assembling holes 20, whereas the second wide portion 15 of the first exposed panel 8 is formed with assembling projections 21 at positions that substantially align with the assembling holes 20. The three-layered shaft fixing portion 5 is fixed by fitting the assembling projections 21 into the assembling holes 20 to prevent the respective panels 7, 8 and 9 from getting loose.

The two exposed panels 8, 9 are connected by a first connecting portion 19 that connects middle sections of the respective wide portions 14, and the first exposed surface panel 8 and the intermediate panel 7 are connected by a second connecting portion 22.

Figure 4:
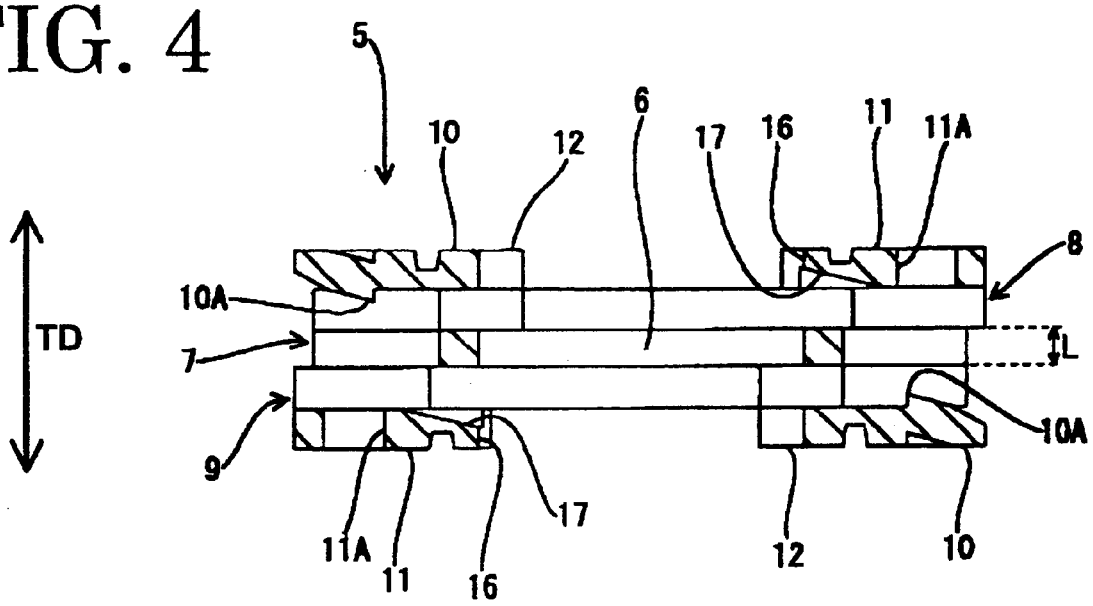
FIG. 4 is a section along 4—4 of FIG. 3.

The terminal fitting 1 is constructed, as shown in FIG. 1, so that the first engaging portion 10 of the second exposed panel 9 at the bottom side projects obliquely down and to right in the plane of FIG. 1, whereas the first engaging portion 10 of the first exposed panel 8 at the top side projects obliquely up and to left (see also FIG. 4). This construction, in which the first engaging portions 10 of the exposed panels 8, 9 differ at the top and bottom side, also applies for the second terminal fitting 25. Thus, the terminal fittings 1, 25 are placed one over another along the thickness direction TD so that an upper terminal fitting is assembled with a lower terminal fitting from the upper right side when viewed in an extending or longitudinal direction LD of the wire W in FIG. 9.

The terminal fittings 1 and 25 differ from each other as follows. The wire connecting portion 3 of the first terminal fitting 1 is connected with the left end of the shaft fixing portion 5 when viewed in a direction in which the wire connecting portion 3 is crimped into connection with the wire W (when viewed from above in FIG. 1). On the other hand, the wire connection portion 3 is connected with the right end of the shaft fixing portion 5 when viewed in a similar direction. In other words, the wire connection portions 3 of the two terminal fittings 1, 25 are connected laterally to the respective shaft fixing portion 5 so as to be offset with respect to each other along an offset direction OD that is substantially normal to the thickness direction TD and/or to the extending longitudinal direction LD of the wires W. Thus, the arranged positions of the wire connecting portions 3 are offset along the offset direction OD between the terminal fittings 1 and 25 even if the wires W are placed one over the other with their extending directions aligned. Therefore, the wires W and the wire connecting portions 3 do not interfere with each other.

FIG. 9 shows a state where four terminal fittings are placed one over another by arranging the terminal fittings 1, 25 as intermediate terminal fittings and arranging a pair of end terminal fittings 23, 24 respectively above and below the terminal fittings 25, 1.

The end terminal fittings 23, 24 have many structural similarities to the above-described first and second terminal fittings 1 and 25. Components of the end terminal fittings 23, 24 that are the same as the first and second terminal fittings 1, 25 merely are identified by the same reference numerals, and there is no new description of these previously described parts. Each terminal fitting 23, 24 is formed by bending a metallic plate stamped into a specified shape and is provided with only one pair of engaging portions 10, 11, and only one of the upper or lower surfaces thereof can be joined with another terminal fitting. The position of the wire connecting portion 3 relative the shaft fixing portion 5 has a reversed relationship in the respective terminal fittings 23, 24, similar to the relationship between the terminal fittings 1 and 25. Further, the surfaces of the respective terminal fittings 23, 24 toward a head 4A of the bolt 4 and toward a fixing location 26 are free from projections, so that the terminal fittings 23, 25 can be held in surface contact with the head 4A and the fixing location 26.

The wires W are connected with the respective wire connecting portions 3 before the respective terminal fittings 1, 23, 24, 25 are united. Further, the terminal fittings 1, 23, 24, 25 are united such that the wire connecting portions 3 are oriented to face in the same direction, as shown in FIG. 9.

The end terminal fitting 24 and the terminal fitting 1 are united initially. More particularly, the first engaging portion 10 of the second exposed panel 9 of the terminal fitting 1 is inserted inside the bolt insertion hole 6 of the end terminal fitting 24. Simultaneously, the first engaging portion 10 of the end terminal fitting 24 is inserted inside the bolt insertion hole 6 of the terminal fitting 1. Subsequently, the terminal fittings 1, 24 are slid with respect to each other to align the bolt insertion holes 6 of the terminal fittings 1, 24. Thus, the terminal fittings 1 and 24 are slid in directions to engage the first engaging portions 10 of the respective terminal fittings 1, 24 with the second engaging portions 11 of the mating terminal fittings 24, 1. The projections 10A of the respective first engaging portions 10 then are fitted into the holes 11A of the second engaging portions 11 of the mating terminal fittings to hold the terminal fittings 1, 24 united. In other words, the terminal fittings 1, 24 are latched to each other by the interlocking of the first engaging portions 10 of the respective terminal fittings 1, 24 with the second engaging portions 11 of the mating terminal fittings 24, 1.

Subsequently, the second exposed panel 9 of the terminal fitting 25 is connected with the first exposed panel 8 of the terminal fitting 1. No description is given on a method for assembling the terminal fittings 1, 25 since it is similar to the method for assembling the terminal fittings 1 and 24. At this time, the direction in which the terminal fitting 25 is assembled is the same as the assembling direction or thickness direction TD of the terminal fittings 1 and 24.

Finally, the end terminal fitting 23 is joined with the first exposed panel 8 of the terminal fitting 25. The assembling direction and the assembling method are same as the aforementioned direction and method. Thus, the terminal fittings 1, 23, 24 and 25 are united by engaging the engaging portions 10, 11, as shown in FIG. 10. At this time, the positions of the wire connecting portions 3 are alternated along the offset direction OD at the first arranged position and the second arranged position in the vertically adjacent terminal fittings. A plurality of terminal fittings 1, 23, 24 and 25 thus united can be fixed to the specified fixing location 26 by the bolt 4.

As described above, a plurality of terminal fittings 1, 25 can be placed one over another in thickness direction TD while being united together by the engaging portions 10, 11. Thus, the ends of three or more wires can be fixed to one fixing location 26.

Figure 5:
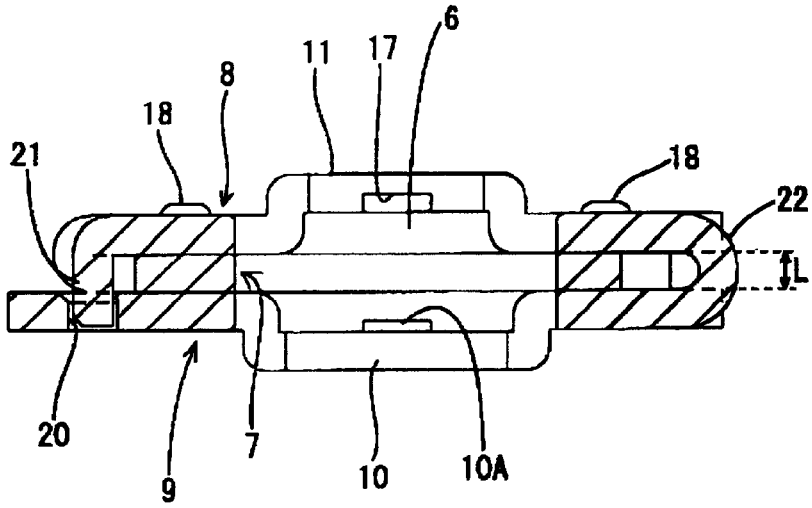
FIG. 5 is a section along 5—5 of FIG. 3.
Figure 6:
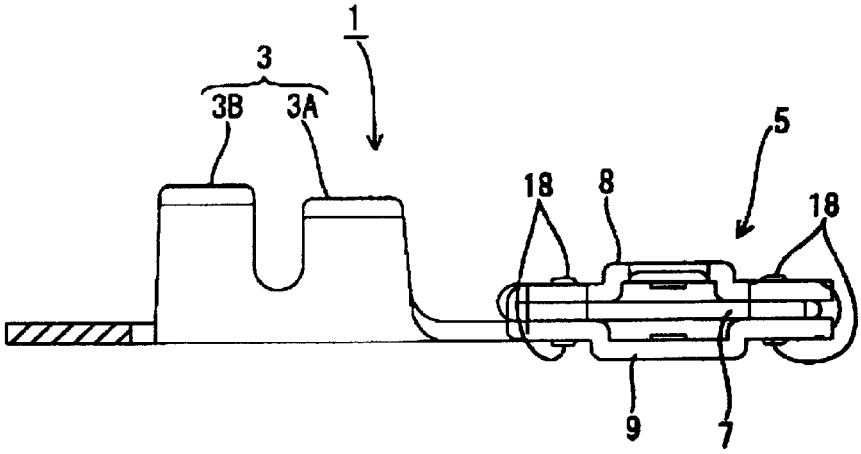
FIG. 6 is a side view of the unitable terminal fitting.
Figure 7:
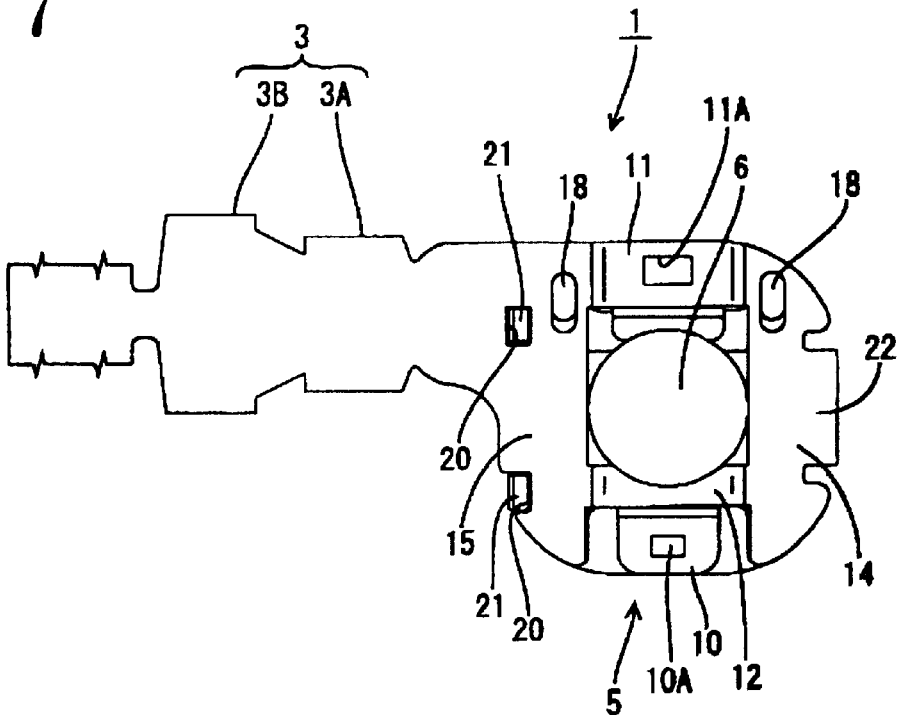
FIG. 7 is a rear view of the unitable terminal fitting.
Figure 8:
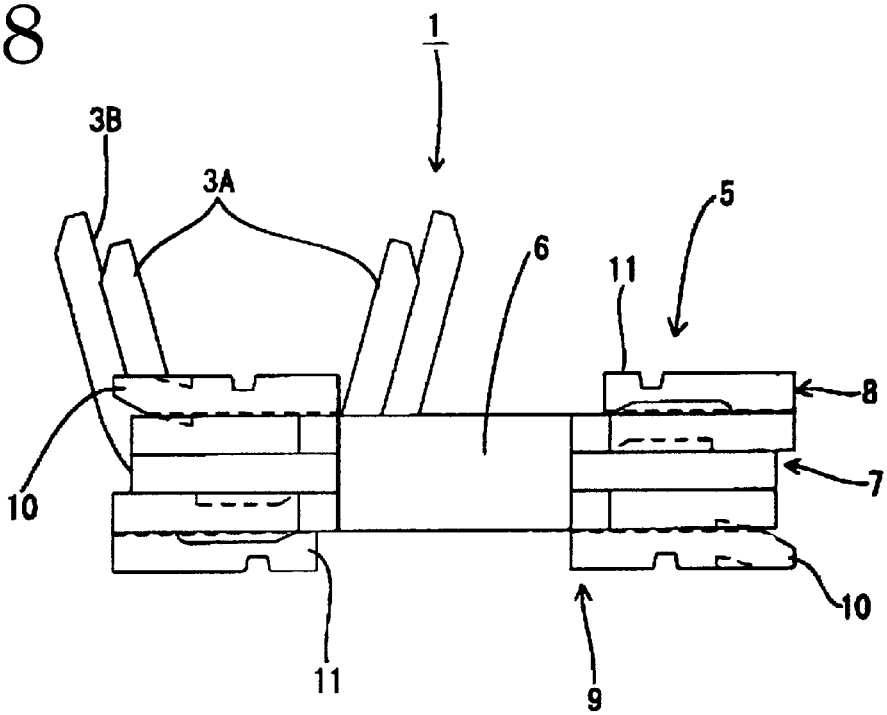
FIG. 8 is a front view of the unitable terminal fitting.

After a plurality of terminal fittings 1, 23, 24 and 25 are united by the engaging portions 10, 11, the bolt 4 is fixed to the specified fixing location 26 and to the shaft fixing portions 5 of the terminal fittings 1, 23, 24 and 25. The engaging portions 10, 11 need a specified engagement margin in the thickness direction TD, as indicated by the thickness L of the intermediate panel 7 shown in FIGS. 4 and 5, to be engageable with each other in the thickness direction TD of the terminal fittings 1, 25. To provide this engagement margin, the two folded sections of the metallic plate material 2 cannot be put together if the engaging portions 10, 11 are at these two folded sections of the terminal fittings 1, 25. Accordingly, a specified clearance needs to be defined between the two folded sections. The clearance between the two folded sections may be squeezed by a compressive force during the mounting of the bolt 4 at the fixing location 26. However, the intermediate panel 7 is held in close contact with both exposed panels 8, 9 and hence there is no possibility of squeezing the clearance between the exposed panels 8, 9.

The assembling portions 20, 21 prevent the shaft fixing portion 5 from getting loose. Thus, the folded sections of the metallic plate of the shaft fixing portion 5 is prevented from getting loose even when the terminal fittings 1, 25 are left alone.

A plurality of terminal fittings 1, 25 are united together so that the wire connecting portions 3 are alternately located along the offset direction Od at the first arranged position and at the second arranged position along the longitudinal direction of the bolt 4. Thus, the wires W and the wire connecting portions 3 are not a hindrance when the terminal fittings 1, 25 are united.

The end terminal fittings 23, 24 at the opposite ends of the terminal fitting assembly with respect to thickness direction TD each are provided with one engaging portion 10 and one engaging portion 11. Thus, when a plurality of the united terminal fittings 1, 23, 24, 25 are fixed by the bolt 4, they can be fixed stably since the end terminal fittings 23, 24 are in surface contact with the head of the bolt 4 and the fixing location 26.

Furthermore, since all the terminal fittings 1, 23, 24, 25 are assembled in the same direction, they can be assembled more smoothly.

Figure 11:
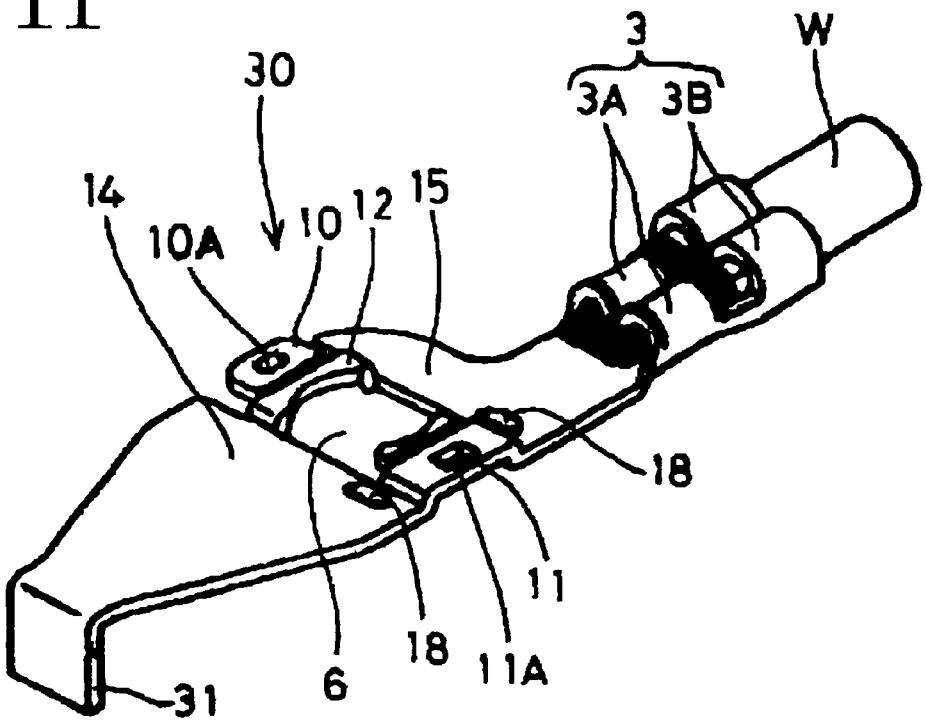
FIG. 11 is a perspective view showing a modification of the lower end terminal fitting.
Figure 12:
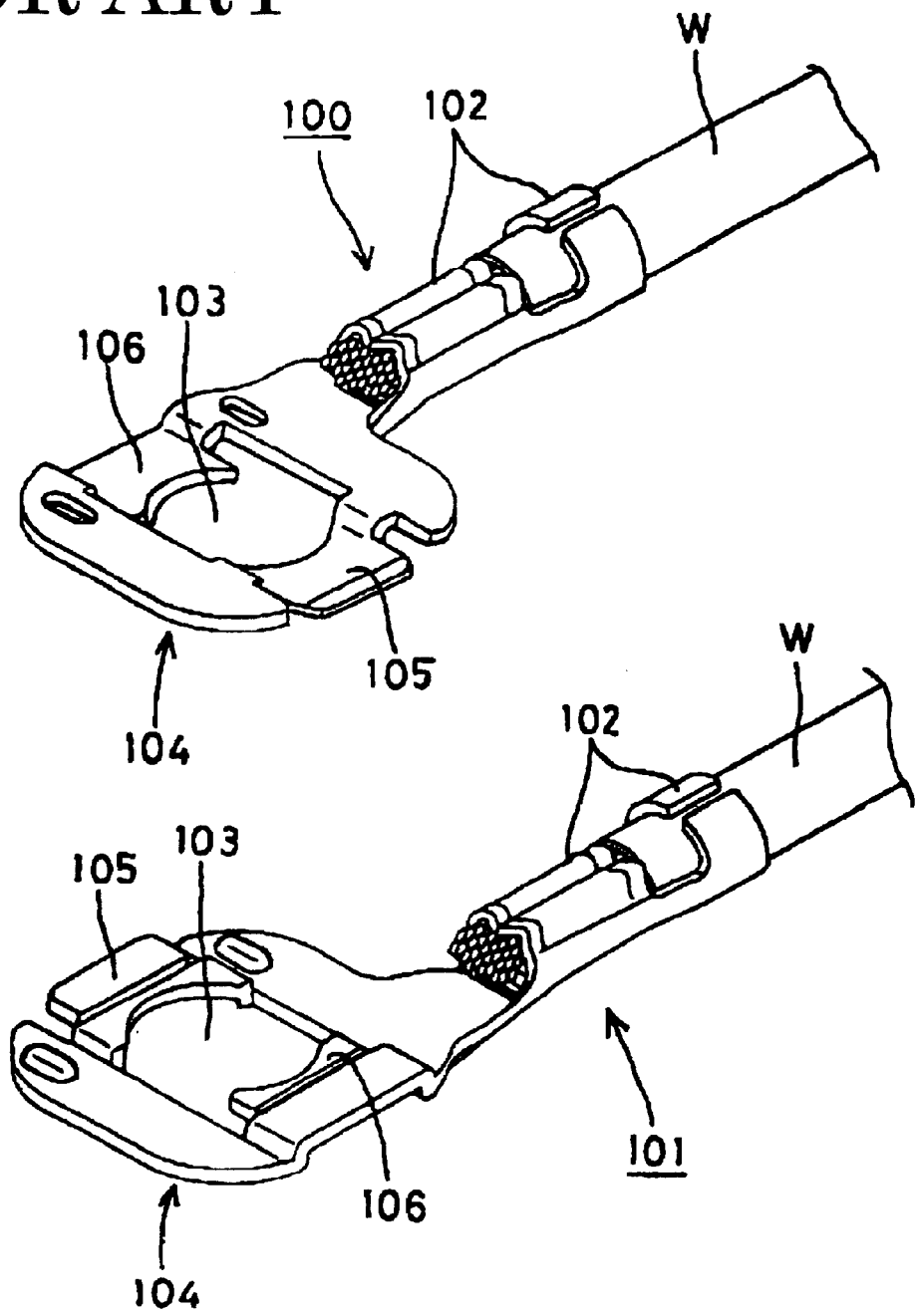
FIG. 12 PRIOR ART
FIG. 12 is a perspective view of prior art unitable terminal fittings before being united.
Figure 13:
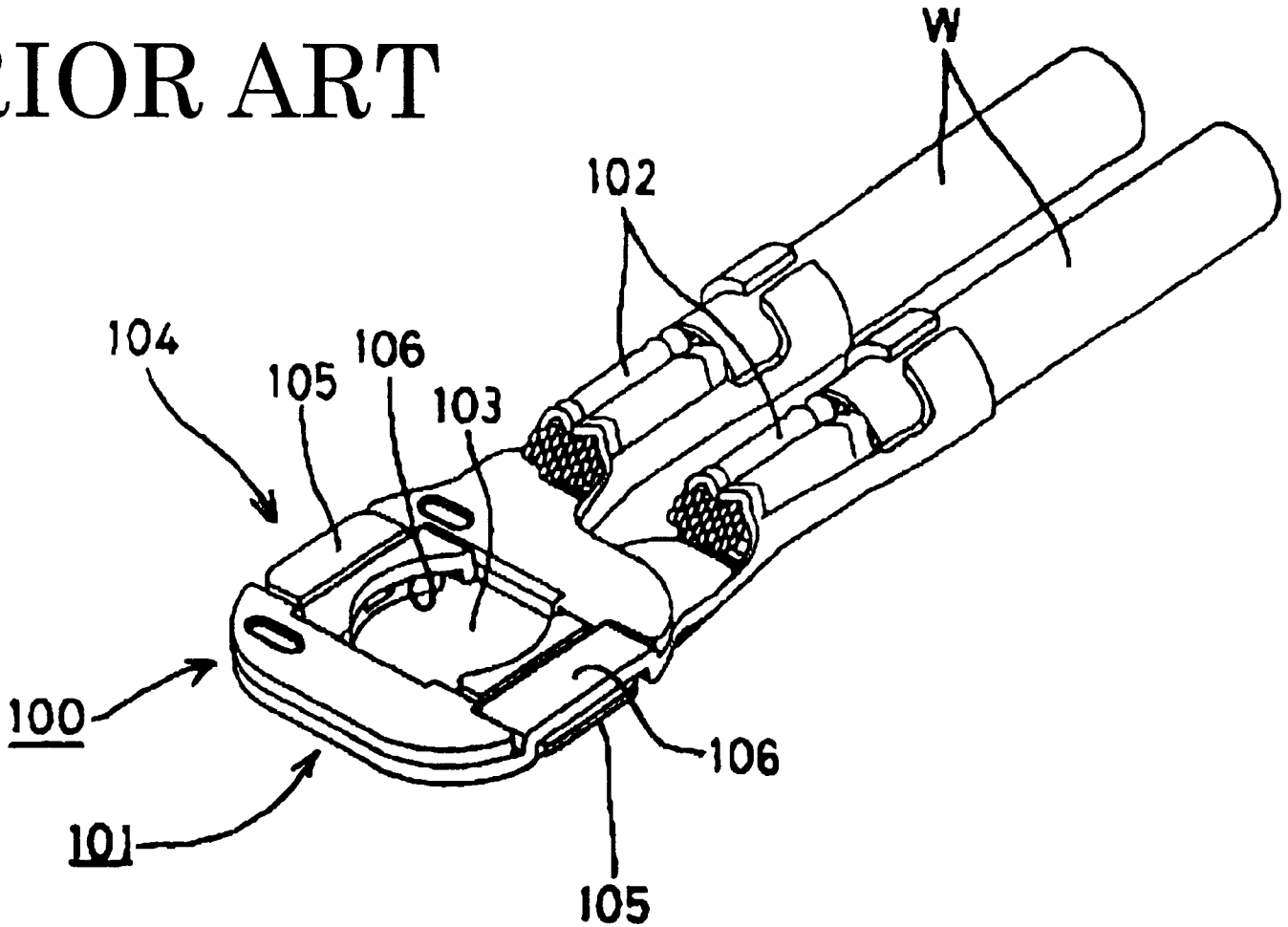
FIG. 13 PRIOR ART
FIG. 13 is a perspective view of the prior art unitable terminal fittings united together.

As shown in FIG. 11, an end terminal fitting 30 to be held in contact with the fixing location 26 may be provided with a turn-stop portion 31. The turn-stop portion 31 can be fitted in a groove (not shown) formed near the fixing location 26 to prevent the terminal fittings from being turned when the bolt 4 is tightened. Therefore, the bolt can be more easily tightened.

The present invention is not limited to the above embodiment. For example, following embodiments are also embraced by the technical scope of the present invention as defined in the claims. Beside the following embodiments, the present invention also extend to the scope of equivalents.

Although the four terminal fittings 1, 23, 24 and 25 are united in the foregoing embodiment, the number of the terminal fittings to be united does not matter according to the present invention and may be three, five or more.

In the case of uniting a plurality of terminal fittings, the positions of the wire connecting portions 3 are preferably alternated at the first arranged position and at the second arranged position. However, the terminal fittings having the wire connecting portions at only one arranged position (e.g. either the terminal fittings 1 or 25) may be placed one over another.

What is claimed is:

1. A unitable terminal fitting having a wire connecting portion for connection with an end of a wire and constructed such that a plurality of the terminal fittings can be united by being placed one over another in a thickness direction of the terminal fittings, wherein the terminal fitting comprises first and second exposed surfaces that are opposite to each other with respect to the thickness direction of the terminal fitting, and wherein both the first and second exposed surfaces comprise projections and recesses configured for holding the terminal fitting united with a mating terminal fitting by being engageable with the respective recesses and projections on the second surface of the respective mating terminal fitting, the terminal fitting being formed by bending a metallic plate to have first and second exposed panels and an intermediate panel held in close contact between the first and second exposed panels, and the projections and recesses being provided around a shaft fixing portion through which a shaft is insertable and wherein the first and second exposed surfaces are on the first and second exposed panels.

2. The unitable terminal fitting of claim 1, wherein the wire connecting portion is arranged such that the terminal fittings can be united with extending directions of the wires being substantially aligned.

3. The unitable terminal fitting of claim 1, wherein the terminal fitting is configured such that a plurality of the terminal fittings can be placed substantially one over another in the thickness direction by means of the shaft, and such that the wire connecting portions of the respective terminal fittings are alternately located at a first arranged position and at a second arranged position offset in an offset direction from the first position.

4. The unitable terminal fitting of claim 1, wherein guide means are provided for guiding the projections and recesses into engagement.

5. The unitable terminal fitting of claim 1, wherein the projections and recesses are connectable with one another by movement substantially normal to a direction of mounting of the unitable terminal fitting to a shaft.

6. The unitable terminal fitting of claim 5, wherein at least one of the projections and recesses comprise a positioning edge projecting toward a shaft insertion hole so as to conform to the shaft.

7. A unitable terminal fitting having a wire connecting portion for connection with an end of a wire and constructed such that a plurality of the terminal fittings can be united by being placed one over another in a thickness direction of the terminal fittings, wherein the terminal fitting comprises first and second exposed surfaces that are opposite to each other with respect to the thickness direction of the terminal fitting, and wherein both the first and second exposed surfaces comprise projections and recesses configured for holding the terminal fitting united with a mating terminal fitting by being engageable with the respective recesses and projections on the second surface of the respective mating terminal fitting, wherein the terminal fitting is formed by bending a metallic plate, and the terminal fitting comprises a shaft fixing portion through which a shaft to which the terminal fitting is to be fixed is insertable, wherein the shaft fixing portion is formed by folding the metallic plate at least in two, and mutually engaged assembling portions being provided at folded sections of the metallic plate for preventing the folded sections of the metallic plate that forms the shaft fixing portion from getting loose.

8. A unitable terminal fitting having a wire connecting portion for connection with an end of a wire and constructed such that a plurality of the terminal fittings can be united by being placed one over another in a thickness direction of the terminal fittings, wherein the terminal fitting comprises first and second exposed surfaces that are opposite to each other with respect to the thickness direction of the terminal fitting, and wherein both the first and second exposed surfaces comprise projections and recesses configured for holding the terminal fitting united with a mating terminal fitting by being engageable with the respective recesses and projections on the second surface of the respective mating terminal fitting, wherein the terminal fitting is formed by bending a metallic plate, and the terminal fitting comprises a shaft fixing portion through which a shaft to which the terminal fitting is to be fixed is at least partly insertable, the shaft fixing portion being formed by folding the metallic plate at least in two to define at least two bent portions in contact with each other by at least one contact projection.

9. A construction for uniting a plurality of terminal fittings to be fixed by one shaft, comprising:

at least one intermediate terminal fitting having a wire connecting portion for connection with an end of a wire and constructed such that a plurality of the intermediate terminal fitting can be united by being placed one over another in a thickness direction of the intermediate terminal fittings, the intermediate terminal fitting comprising first and second exposed surfaces that are opposite to each other with respect to the thickness direction, both the first and second exposed surfaces comprising projections and recesses for holding the terminal fitting united with a mating terminal fitting by being engageable with the respective recesses and projections on the second surface of the respective mating terminal fitting, and first and second end terminal fittings located at opposite sides of the intermediate terminal fitting along the thickness direction, the end terminal fittings each comprising a wire connecting portion and a shaft fixing portion, one projection and one recess being formed on one surface of each of said end terminal fittings, the projections and recesses of each said terminal fitting being engageable with the respective recesses and projections on at least one other of the terminal fitting, wherein at least one end terminal fitting is provided with a turn-stop portion for preventing turning of the terminal fittings relative to one another.

10. A method for forming a unitable terminal fitting having a wire connecting portion to be connected with an end of a wire and constructed such that a plurality of the terminal fittings can be united by being placed one over another in the thickness direction of the terminal fittings, comprising the steps of:

providing a metallic plate;

forming the metallic plate to define an intermediate panel, a first exposed panel and a second exposed panel with bolt insertion holes for receiving a shaft;

providing projections and recesses on both the first and a second exposed panels;

bending the metallic plate to form the terminal fitting with the intermediate panel between and in close contact with the first and second exposed panels, such that the projections and recesses are opposite to each other with respect to the thickness direction of the terminal fitting, wherein the terminal fitting can be united with a mating terminal fitting by engaging the projection and recess of the terminal fitting with the respective recess and projection on the mating terminal fitting.

11. The method of claim 10, wherein the wire connector portions are formed such that when a plurality of the terminal fittings are placed substantially one over another in thickness direction by means of the shaft, the wire connecting portions of the respective terminal fittings are alternately located at a first arranged position and at a second arranged position offset in an offset direction from the first position.

12. A method for forming a unitable terminal fitting having a wire connecting portion to be connected with an end of a wire and constructed such that a plurality of the terminal fittings can be united by being placed one over another in the thickness direction of the terminal fittings, comprising the steps of:

providing a metallic plate;

bending the metallic plate at least in two to form the terminal fitting;

forming a shaft fixing portion of the terminal fitting through which a shaft is at least partly insertable;

providing projections and recesses on both a first surface and a second surface of the terminal fitting, said first and second surfaces being opposite to each other with respect to a thickness direction of the terminal fitting;

wherein the terminal fitting can be united with a mating terminal fitting by engaging the projection and recess on the first surface of the terminal fitting with the respective recess and projection on the second surface of the mating terminal fitting; and wherein assembling portions are provided at folded sections of the metallic plate material for preventing the folded sections of the metallic plate of the shaft fixing portion from getting loose.

* * * * *